United States Patent [19]

Arakawa

[11] Patent Number: 5,065,021

[45] Date of Patent: Nov. 12, 1991

[54] METHOD OF AND SYSTEM FOR ERASING RADIATION IMAGE

[75] Inventor: Satoshi Arakawa, Kanagawa, Japan

[73] Assignee: Fuji Photo Film Co., Ltd., Kanagawa, Japan

[21] Appl. No.: 687,791

[22] Filed: Apr. 19, 1991

[30] Foreign Application Priority Data

Apr. 19, 1990 [JP] Japan ..... 2-103397

[51] Int. Cl.[5] ..... G03C 5/16

[52] U.S. Cl. ..... 250/327.2; 250/484.1

[58] Field of Search ..... 250/327.2, 484.1

[56] References Cited

U.S. PATENT DOCUMENTS

| | | | |
|---|---|---|---|
| 4,258,264 | 3/1981 | Kotera et al. | 250/327.2 |
| 4,276,473 | 6/1981 | Kato et al. | 250/327.2 |
| 4,315,318 | 2/1982 | Kato et al. | 364/515 |
| 4,387,428 | 6/1983 | Ishida et al. | 364/414 |
| 4,400,619 | 8/1983 | Kotera et al. | 250/327.2 |
| 4,439,682 | 3/1984 | Matsumoto et al. | 250/327.2 |
| 4,496,838 | 1/1985 | Umemoto et al. | 250/327.2 |
| 4,584,483 | 4/1986 | Kato | 250/327.2 |
| 4,755,672 | 7/1988 | Watanabe et al. | 250/327.2 |
| 4,975,935 | 12/1990 | Hillen et al. | 250/370.09 |

FOREIGN PATENT DOCUMENTS 56-11395 2/1981 Japan .

*Primary Examiner*—Carolyn E. Fields
*Assistant Examiner*—Drew A. Dunn
*Attorney, Agent, or Firm*—Sughrue, Mion, Zinn, Macpeak & Seas

[57] ABSTRACT

After a radiation image stored on a stimulable phosphor sheet is read out, the stimulable phosphor sheet is first exposed to first erasing light containing therein light having wavelengths within the ultraviolet range and then exposed to second erasing light having wavelengths longer than the ultraviolet range.

4 Claims, 1 Drawing Sheet

METHOD OF AND SYSTEM FOR ERASING RADIATION IMAGE

BACKGROUND OF THE INVENTION

1. Field of the Invention

This invention relates to a method of and system for erasing a radiation image remaining on a stimulable phosphor sheet after the stimulable phosphor sheet is exposed to stimulating rays in order to read out the radiation image stored thereon.

2. Description of the Prior Art

When certain kinds of phosphors are exposed to radiation such as X-rays, $\alpha$-rays, $\beta$-rays, $\gamma$-rays, cathode rays or ultraviolet rays, they store part of the energy of the radiation. Then, when the phosphor which has been exposed to the radiation is exposed to stimulating rays such as visible light, light is emitted by the phosphor in proportion to the amount of energy stored during exposure to the radiation. A phosphor exhibiting such properties is referred to as a stimulable phosphor.

As disclosed in U.S. Pat. Nos. 4,258,264, 4,276,473, 4,315,318 and 4,387,428 and Japanese Unexamined Patent Publication No. 56(1981)-11395, it has been proposed to use stimulable phosphors in radiation image recording and reproducing systems. Specifically, a sheet provided with a layer of the stimulable phosphor hereinafter referred to as a stimulable phosphor sheet) is first exposed to radiation which has passed through an object such as the human body in order to store a radiation image of the object thereon, and is then scanned with stimulating rays, such as a laser beam, which cause it to emit light in proportion to the amount of energy stored during exposure to the radiation. The light emitted by the stimulable phosphor sheet upon stimulation thereof is photoelectrically detected and converted into an electric image signal, which is used when the radiation image of the object is reproduced as a visible image on a recording material such as photographic film, a display device such as a cathode ray tube (CRT), or the like.

Further, there has been proposed various methods of processing the electric image signal, before it is used for reproducing the radiation image of the object, so that the visible image thus produced has an improved image quality, which makes it an effective tool when illnesses must be efficiently and accurately diagnosed. (See Japanese Unexamined Patent Publication No. 56(1981)-11395, and U.S. Pat. Nos. 4,258,264, 4,276,473, 4,315,318, and 4,387,428 and the like.) According to the teachings of those patent publications, it is preferred that a stimulable phosphor which emits light of 300 to 500 nm upon stimulation by stimulating rays of 600 to 700 nm be used in order to separate the wavelength range of the light emitted by the stimulable phosphor sheet from that of the stimulating rays and to detect at high efficiency the light emitted by the stimulable phosphor sheet which is very weak.

In view of economy, it is preferred that the stimulable phosphor sheet be repeatedly reused. Strictly speaking, the stimulable phosphor sheet is used in various forms, (e.g., in the form of a drum or in the form of a panel). However, in this specification, all the recording media having a stimulable phosphor layer will be referred to as "the stimulable phosphor sheet".

Though the radiation energy stored on the stimulable phosphor sheet during exposure to radiation should be completely released if the stimulable phosphor sheet is exposed to stimulating rays of a sufficient intensity during read-out of the radiation image, actually the radiation energy cannot be completely released only by exposure to the stimulating rays. Thus there arises a problem that, when the stimulable phosphor sheet is reused, part of the radiation energy stored on the stimulable phosphor sheet upon a radiation image recording is not released during exposure to the stimulating rays and can result in noise of the radiation image recorded in the following radiation image recording.

Further since a trace amount of radioisotopes such as $^{226}Ra$, $^{40}K$ and the like are included in the stimulable phosphor, radiation energy accumulates in the stimulable phosphor sheet due to radiation emitted by such radioisotopes even if the stimulable phosphor sheet is left as it is. The radiation energy which accumulates in the stimulable phosphor sheet while it is left as it is (will be referred to as "fog", hereinbelow) can also result in noise of the radiation image recorded in the following radiation image recording.

In order to prevent generation of noise due to the remaining part of the radiation energy and the fog, this applicant has proposed methods of erasing the stimulable phosphor sheet in which the stimulable phosphor sheet is exposed to erasing light containing light having wavelengths within the stimulating wavelength range so that the radiation image remaining on the stimulable phosphor sheet is sufficiently released prior to the following radiation image recording.

In one of such methods, a light source which emits relatively long wavelength light ranging from visible light to infrared light, e.g., a tungsten lamp, a halogen lamp and an infrared lamp, is used as the source of the erasing light (U.S. Pat. No. 4,400,619). In another method, a light source which emits relatively short wavelength light ranging from 400 to 600 nm, e.g., a fluorescent tube, a laser, a Na-lamp, a Ne-lamp, a metal halide lamp, a Xe-lamp, is used as the source of the erasing light (U.S. Pat. No. 4,496,838). In still another method, after the stimulable phosphor sheet is once exposed to erasing light, the stimulable phosphor sheet is again exposed to erasing light at an intensity of 1/5 to 3/10000 of the intensity of the erasing light in the first erasure immediately before it is reused (U.S. Pat. No. 4,439,682). It is said that most efficient erasure takes place when visible range light is used as the erasing light.

However, when erasure is effected by the use of erasing light containing therein no ultraviolet range light, remaining radiation energy in the form of relatively deep trapped electrons which is difficult to release by visible light cannot be sufficiently released. On the other hand, when erasure is effected by the use of erasing light containing a large quantity of ultraviolet range light, the ultraviolet range light itself produces other trapped electrons and accordingly the radiation energy cannot be sufficiently released though the remaining radiation energy in the form of relatively deep trapped electrons can be released.

Thus, it is very difficult to release both the radiation energy in the form of deep trapped electrons and the radiation energy in the form of normal trapped electrons at one time and effectively release the remaining radiation energy. Accordingly, in the present state, influence of the remaining radiation energy cannot be satisfactorily avoided especially when the high-sensitive recording is effected on a reused stimulable phosphor sheet.

SUMMARY OF THE INVENTION

In view of the foregoing observations and description, the primary object of the present invention is to provide a method of and a system for erasing a stimulable phosphor sheet which can efficiently release remaining radiation energy in the form of deep trapped electrons in addition to remaining radiation energy in the form of normal trapped electrons.

The method of erasing a stimulable phosphor sheet in accordance with the present invention is characterized in that the stimulable phosphor sheet is first exposed to first erasing light containing therein light having wavelengths within the ultraviolet range and then exposed to second erasing light having wavelengths longer than the ultraviolet range.

The system for erasing a stimulable phosphor sheet in accordance with the present invention comprises a first erasing light source which emits first erasing light containing therein light having wavelengths within the ultraviolet range, a second erasing light source which emits second erasing light having wavelengths longer than the ultraviolet range, and a control means for exposing the stimulable phosphor sheet first to the first erasing light and then to the second erasing light.

The second erasing light need not be obtained solely from a light source but may be obtained by combination of a light source and a sharp-cut filter or the like.

By exposure to the first erasing light, remaining radiation energy up to deep trapped electrons is released, and relatively shallowly trapped electrons produced by exposure to the first erasing light are released by exposure to the second erasing light, whereby the remaining radiation energy can be released to a sufficiently low level.

Thus, the remaining radiation energy from shallowly trapped electrons to deep trapped electrons can be sufficiently released from the stimulable phosphor sheet and a radiation image excellent in quality can be obtained even if high-sensitive radiation image recording is effected on the stimulable phosphor sheet.

Though some of the trapped electrons produced by exposure to the first erasing light are trapped deep, the number of such deep trapped electrons is negligible.

DESCRIPTION OF THE PREFERRED EMBODIMENTS

Figure 1:
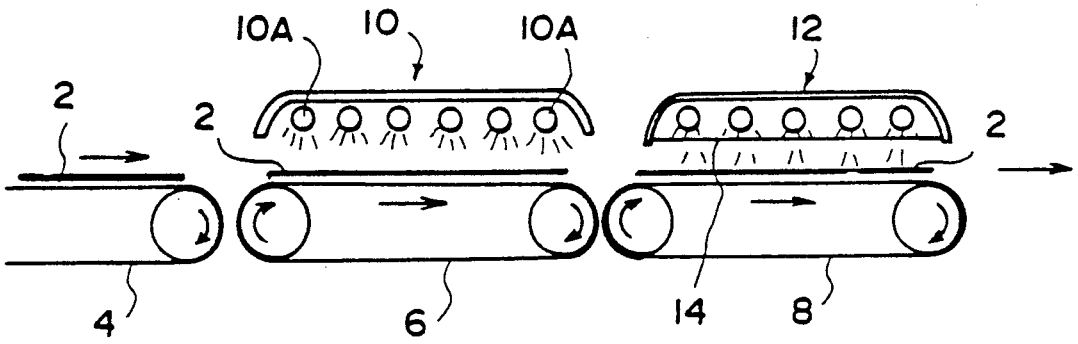
FIG. 1 is a side view of an erasing system in accordance in an embodiment of the present invention.

In FIG. 1, a stimulable phosphor sheet 2 a radiation image on which has been read out is delivered to a second conveyor belt 6 from a first conveyor belt 4. The second conveyor belt 6 conveys the stimulable phosphor sheet 2 below a first erasing light source 10 and delivers it to a third conveyor belt 8 which conveys it below a second erasing light source 12. While the stimulable phosphor sheet 2 is conveyed by the second conveyor belt 6, the first erasing light source 10 is energized and the stimulable phosphor sheet 2 is exposed to first erasing light emitted from the first erasing light source 10, and while the stimulable phosphor sheet 2 is conveyed by the third conveyor belt 8, the second erasing light source 12 is energized and the stimulable phosphor sheet 2 is exposed to second erasing light emitted from the second erasing light source 12.

The first erasing light source 10 comprises a plurality of lamps 10A each emitting light containing therein light having wavelengths within the ultraviolet range. For example, various fluorescent tubes, a mercury vapor lamp, a metal halide lamp, an ultraviolet lamp, and the like can be used as the first erasing light source. In order to erase the stimulable phosphor sheet 2 at high efficiency, it is preferred that the first erasing light contains visible light in addition to light having wavelengths within the ultraviolet range. For this purpose, the ultraviolet lamp may be used in combination with a high-pressure or low-pressure sodium vapor lamp.

There have been known various fluorescent tubes such as normal cathode fluorescent tubes emitting white light (W), warm white light (WW), daylight light (D), glow, and high color rendering type white (W-DL), (W-SDL), (W-EDL), and cold cathode fluorescent tubes emitting green (G), blue (B) or high color rendering whight (LCD). Emission of any one of the fluorescent tubes has a wide band spectrum ranging from about 300 nm to 750 nm, and has a wide and high spectrum distribution near 600 nm. Emission of the normal fluorescent tubes has high intensity line spectra near 450 nm and 550 nm. Accordingly, fluorescent tubes can used as the first erasing light source.

Emission of the mercury vapor lamp has several high intensity line spectra in a range from 350 nm to about 600 nm. Accordingly, the mercury vapor lamp also can be used as the first erasing light source.

Emission of the high-pressure sodium vapor lamp has a wide band spectrum ranging from 500 to 700 nm and includes small quantity of light having wavelengths within the ultraviolet range. Accordingly, when the high-pressure sodium vapor lamp is used as the first erasing light source, it is preferred that the high-pressure sodium vapor lamp be used in combination with an ultraviolet light lamp.

Emission of the low-pressure sodium vapor lamp has a high intensity line spectrum near 580 nm but has no available radiation power in the ultraviolet wavelength range. Accordingly, when the low-pressure sodium vapor lamp is used as the first erasing light source, the low-pressure sodium vapor lamp must be used in combination with an ultraviolet light lamp.

Emission of the ultraviolet light lamp such as a black light fluorescent tube (BL), a health radiation fluorescent tube, cold cathode fluorescent tubes (BLE and ULE) and the like has a high intensity band spectrum ranging from 300 nm to 400 nm.

As the second erasing light source 12, all the light sources which can be used as the first erasing light source 10 but the ultraviolet light lamps can be used in combination with a sharp-cut filter or by itself. That is, the light source having spectral distribution in the ultraviolet wavelength range or in a range shorter than the ultraviolet wavelength range is used in combination with a sharp-cut filter 14 which cut light having a wavelength shorter than about 400 nm. On the other hand, those which do not emit light having a wavelength within the ultraviolet wavelength range or shorter than the ultraviolet wavelength range (e.g., low-pressure sodium vapor lamp) can be used as the second erasing light source 12 by itself.

As the sharp-cut filter 14, sharp-cut filter "L-42" (Kabushiki Gaisha HOYA) which transmits only light having a wavelength not shorter than about 420 nm can be suitably used. Also sharp-cut filter "L-40" (Kabushiki Gaisha HOYA) which transmits only light having a wavelength longer than about 390 nm to 410 nm can be used.

When the second erasing light source 12 emits no light having a wavelength within the ultraviolet wavelength range or shorter than the ultraviolet wavelength range, substantially no trapped electron is produced and the object of the present invention can be accomplished.

EXAMPLE

As the first erasing light source 10, a high-pressure sodium vapor lamp in combination with a cold cathode fluorescent tube (BLE) was used, and as the second erasing light source 12, a white fluorescent tube in combination with sharp-cut filter "L-42" was used. A stimulable phosphor sheet a radiation image on which had been read out was exposed to only the first erasing light. In this case, the light emission level by the remaining radiation energy (the ratio of the level 8 hours after exposure to the erasing light to the level before exposure to the erasing light) was $3\times10^{-5}$. When another stimulable phosphor sheet a radiation image on which had been read out was exposed to only the second erasing light, the light emission level by the remaining radiation energy was $2\times10^{-5}$. When still another stimulable phosphor sheet a radiation image on which had been read out was exposed to the first erasing light and then to the second erasing light, the light emission level by the remaining radiation energy fell to $3\times10^{-6}$.

That is, when the stimulable phosphor sheet was first exposed to the first erasing light and then to the second erasing light in accordance with the present invention, the light emission level by the remaining radiation energy was about 1/7 to 1/10 of that when the stimulable phosphor sheet was exposed to only the first erasing light or the second erasing light.

In the embodiment shown in FIG. 1, the first erasing light source 10 and the second erasing light source 12 arranged in a row in this order and the stimulable phosphor sheet 2 is once placed below the first erasing light source 10 and then moved below the second erasing light source 12 after exposure to the first erasing light. However, the system may be arranged so that the stimulable phosphor sheet can be exposed to both the light emitted from the first erasing light source and the light emitted fro the second erasing light source in one position and the first and second erasing light sources are energized in sequence in this order.

Figure 2:
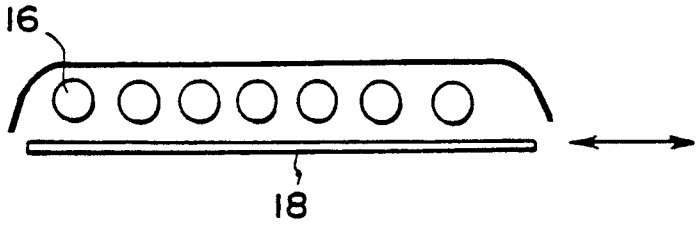
FIG. 2 is a side view of an erasing system in accordance in another embodiment of the present invention.

In the embodiment shown in FIG. 2, erasing light sources 16 emits light containing both light having wavelengths within the ultraviolet range and light having wavelengths longer than the ultraviolet range and a cut filter 18 is provided so that it can be moved between an operative position in which it is positioned between the stimulable phosphor sheet and the light sources 16 to cut the light having wavelengths within the ultraviolet range, and a retracted position in which it is retracted from between the stimulable phosphor sheet and the light sources 16. The light sources 16 are first energized with the filter 18 in the retracted position and then energized again with the filter 18 in the operative position.

The present invention can be applied to stimulable phosphor sheets having known stimulable phosphor such as BaFBr:Eu phosphor or the like. Strictly speaking, the lower limit of the spectral distribution of the second erasing light (about 400 nm) varies depending on the kind of the stimulable phosphor.

I claim:

1. A method of erasing a stimulable phosphor sheet comprising the steps of exposing the stimulable phosphor sheet to first erasing light containing therein light having wavelengths within the ultraviolet range and then exposing the same to second erasing light having wavelengths longer than the ultraviolet range.

2. A system for erasing a stimulable phosphor sheet comprising a first erasing light source which emits first erasing light containing therein light having wavelengths within the ultraviolet range, a second erasing light source which emits second erasing light having wavelengths longer than the ultraviolet range, and a control means for exposing the stimulable phosphor sheet first to the first erasing light and then to the second erasing light.

3. A system as defined in claim 2 in which said control means first moves the stimulable phosphor sheet to a first position in which it can be exposed to the light emitted from the first erasing light source, energizes the first erasing light source, moves the stimulable phosphor sheet to a second position in which it can be exposed to the light emitted from the second erasing light source and energizes the second erasing light source.

4. A system as defined in claim 2 in which said control means places the stimulable phosphor sheet in a position in which is can be exposed to both the light emitted from the first erasing light source and the light emitted from the second erasing light source, and alternately energizes the first and the second erasing light sources in this order.

* * * * *